United States Patent [19]

Lutz

[11] Patent Number: 4,668,166

[45] Date of Patent: May 26, 1987

[54] PUMP

[75] Inventor: Karl Lutz, Wertheim, Fed. Rep. of Germany

[73] Assignee: Firma Karl Lutz, Wertheim, Fed. Rep. of Germany

[21] Appl. No.: 711,523

[22] Filed: Mar. 14, 1985

[30] Foreign Application Priority Data

Apr. 5, 1984 [DE] Fed. Rep. of Germany ..... 3412873

[51] Int. Cl.[4] ..... F04D 29/60

[52] U.S. Cl. ..... 415/219 C; 415/DIG. 3

[58] Field of Search ..... 415/219 C, DIG. 3, 216, 415/217, 213 C

[56] References Cited

U.S. PATENT DOCUMENTS

| | | | |
|---|---|---|---|
| 2,896,544 | 7/1959 | Ogles et al. | 415/143 |
| 2,900,112 | 8/1959 | Edwards | 415/201 |
| 3,146,007 | 8/1964 | Boivie et al. | 415/213 C |
| 3,168,048 | 2/1965 | Toyokura et al. | 415/213 C |
| 3,771,926 | 11/1973 | Pardieck | 415/112 |
| 4,021,145 | 5/1977 | Pepper | 415/201 |
| 4,341,503 | 7/1982 | Gschwender et al. | 415/112 |
| 4,417,850 | 11/1983 | Hacker et al. | 415/213 C |
| 4,523,900 | 6/1985 | Frey | 415/211 |

FOREIGN PATENT DOCUMENTS

| | | | |
|---|---|---|---|
| 12101 | 5/1913 | United Kingdom | 415/143 |
| 453987 | 9/1936 | United Kingdom | 415/199.6 |

*Primary Examiner*—Robert E. Garrett
*Assistant Examiner*—John Kwon
*Attorney, Agent, or Firm*—L. Lawton Rogers, III; Joseph M. Killeen

[57] ABSTRACT

The pump, specifically, barrel pump, can be equipped with exchangeable impellers (8, 8'), which can be screwed onto the lower end of the drive shaft (9). One impeller (8) is designed as an axial impeller, while the other impeller (8') is designed as a radial impeller. The radial impeller needs as intake orifice (37), which is easily exchangeable inside the pump foot. So that both impellers can be installed into otherwise identical pumps, it is necessary to select a larger distance between the impeller and the guide wheel in the case of the radial impeller than in the case of the axial impeller and to furnish the guide wheel with commensurately longer guide blades, which have, at the connection with the forward curved section, a long straight area parallel to the axis. Furthermore, the transportation channel inside the guide wheel is narrowed at the beginning and widens in the course of the axial flowthrough.

17 Claims, 3 Drawing Figures

PUMP

Figure 1:
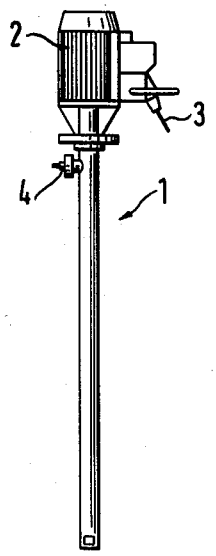

The invention concerns a pump, specifically a barrel pump, with a pipe-shaped housing, which has an outflow at its upper end, and, at its lower end, the pump foot, an intake for the liquid to be transported, a supporting pipe which, with the outer housing, forms an annular transport channel and which serves as the intake for a drive shaft, on the lower end of which is a free-sitting impeller, which is situated inside the housing in the direction of the flow before a permanently fastened guide wheel, whose wings reach to the outer housing, which wings, on the entrance side, exhibit a curved region and an adjacent straight region running parallel to the axis, a region whose length corresponds to a three-fold to six-fold length of the curved region and through which the transportation channel within the curved region of the guide wheel is narrowed down to correspond with the area parallel to the axis.

In the case of an existing pump of this kind (Publication "E & S" screw pumps, construction type "SV" [sic—transl.] of the company Erhardt and Sehmer) the impellers are in fact arranged to be interchangeable, but, in that case, the impellers are of the same type, save only that the number of blades and the way in which they are fastened—that is, fixed or adjustable—can be changed.

A pump already exists (DE-AS No. 15 28 682) in which differing impeller types are installed in a pump housing, but the impellers installed there are of differing diameters. Furthermore, built-in baffles are necessary, which alter the course of the current within the spiral housing. The state of the technology is such that, starting with the same inflow conditions, the outflow conditions for both impeller types are changed, which has a considerable effect on the interior of the pump with its corresponding baffles. A pump of this sort with a spiral housing is not at all suitable as a barrel pump, because of the geometry of its housing and the outer measurements necessitated by the housing.

The purpose of the invention is to facilitate different transport characteristics of the pump in a simple way; that is, to achieve, in a simple way, the transformation from a pump suitable for pumping a large amount over a short distance to one suitable for pumping a small amount over a long distance.

This purpose is achieved by the characteristics enumerated in claim 1. Through this configuration, in order to switch from one use or application of the pump to another, one need only change the impellers, whereby, in the case of the radial impeller, the intake orifice must be involved in the exchange. Thus, if the axial impeller were installed earlier, then it would have to be removed and replaced by the radial impeller, at which point the intake orifice would have to be replaced. However, at the switch from this configuration to the axial impeller, the intake piece and the radial impeller would have to be removed and the axial impeller inserted. Since these parts are designed to be easily exchangeable, the conversion of the pump from one method of operation to another demands an extremely small expenditure of effort, and can be carried out in a short time.

With this invention, in contrast with the state-of-the-art of DE-AS No. 15 28 682, the outflow conditions past the axial impeller are kept constant, and the outer diameters of the impellers are, commensurately, of the same size, so that only the intake conditions are affected by the replacement or removal of the intake orifice, which is easily removable and replaceable. In this way, the pump can retain its outer dimensions, which is an important attribute for a barrel pump, since the openings provided for the removal of fluids from barrels are correspondingly narrow. Since the largest possible outer diameter for both impeller types (which, in essence, is the same as the inner diameter of the pump housing) is made possible, we can create the most favorable transport conditions for whichever type of impeller is used.

The exchangeability of the impellers becomes possible, first of all, because of the special configuraion of the guide wheel, which is described more explicitly in claims 2 through 12. The invention lies, then, not only in the fact that the impellers can be exchanged with one another, but also in the corresponding specifications for the guide wheel, which make these exchanges possible without sacrificing any efficiency in the pump's performance. In other pumps up to now, the guide wheel has always been predicated on the impeller, and, at the entrance side, in the case of a pump with a radial impeller, the intake orifice was permanently attached to the pump foot so that, for these reasons, an exchange of the impellers could not be made, even if the outer diameters of the impellers had been intentionally attuned to one another. Because of this invention, it is also possible that, on the entrance side, the necessary alterations can be carried out quickly and that, on the exit side, preconditions have been created which make possible the use of two different impellers in the same pump. These specifications are evident not only in the design of the guide wheel, but also in the differential choice of the distances between the impeller and the guide wheel.

Further beneficial accomplishments of this invention derive from the dependent claims, in which beneficial points of the impellers, the guide wheel, and their mutual positions are given.

Because of the configuration of this invention, it is possible to transform the transport pump with few hand motions, so that, in the one case, a small amount can be transported a long distance, and, in the other case, a large amount can be transported a short distance, whereby, through corresponding attunement, as described in the points of the dependent claims, it is possible without further ado to arrange the configuration so that transport distance and transport amount can, at the exchange of one impeller for another, be halved or, as the case may be, doubled. That is, at the exchange from one impeller to another, for example, the transport height is halved, and, therefore, the amount transported is doubled compared with that of the preceding impeller. The user therefore only needs one pump, two different impellers, and a supplemental intake orifice to be installed with the radial impeller. Some of the dependent claims cover the simplified exchangeability of the impellers and of the intake orifice, whereby the exchangeability of the guide wheel serves to make the pump easy to repair, since the bearing arrangements for the drive shaft in the lower section are provided for within the hub of the guide wheel. This simplified exchangeability can be ascribed to the fact that the tubular housing is constructed from a single piece of tubing, which has a constant diameter, with only a small amount of boring in the lower section, in which the guidewheel unit is located, and the guide wheel can therefore be inserted into the housing with a tight fit, and the gap between the impeller and the housing can be kept very narrow, which has a favorable effect on the pump's efficiency.

Figure 2:
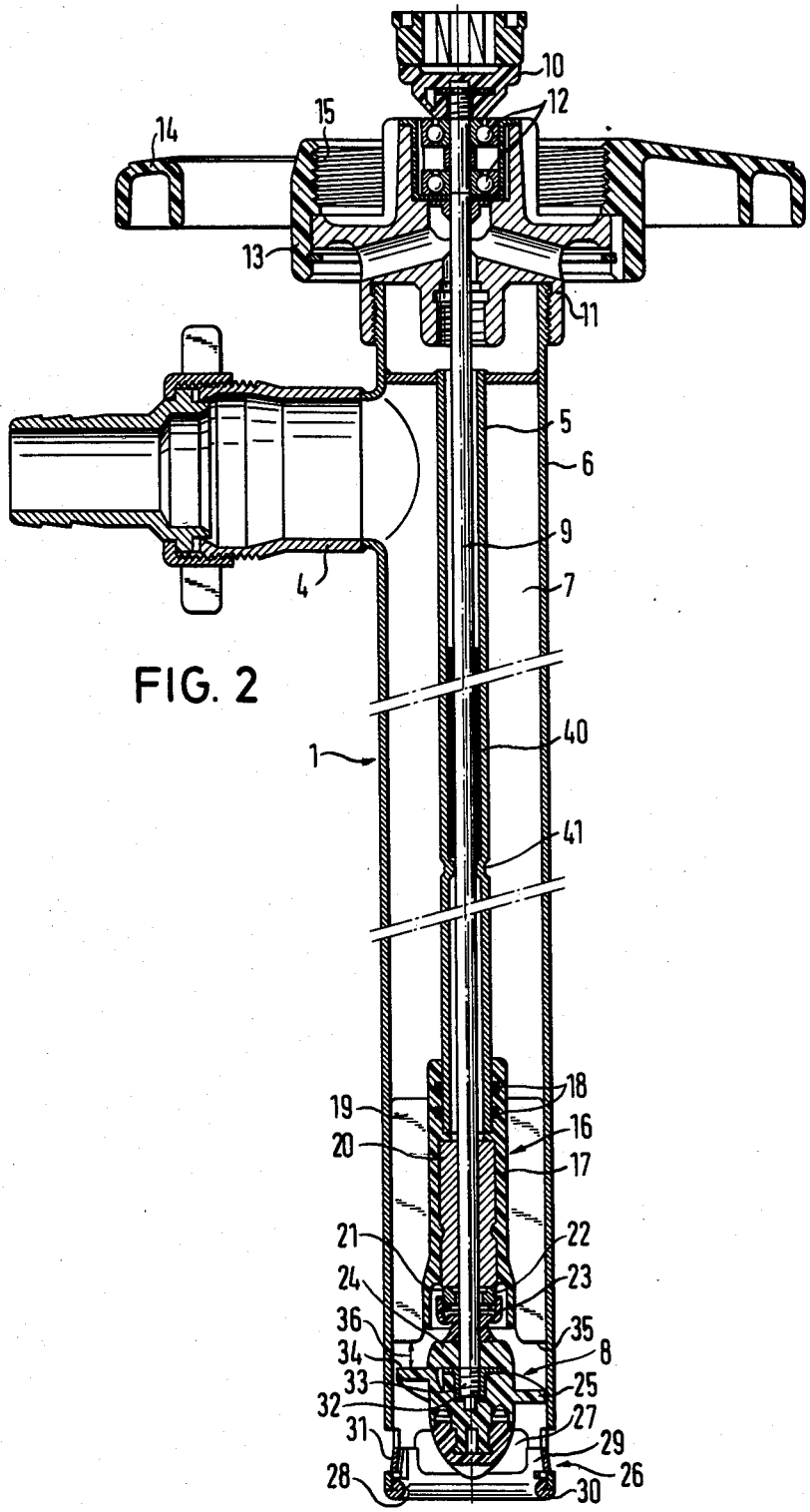
Figure 3:
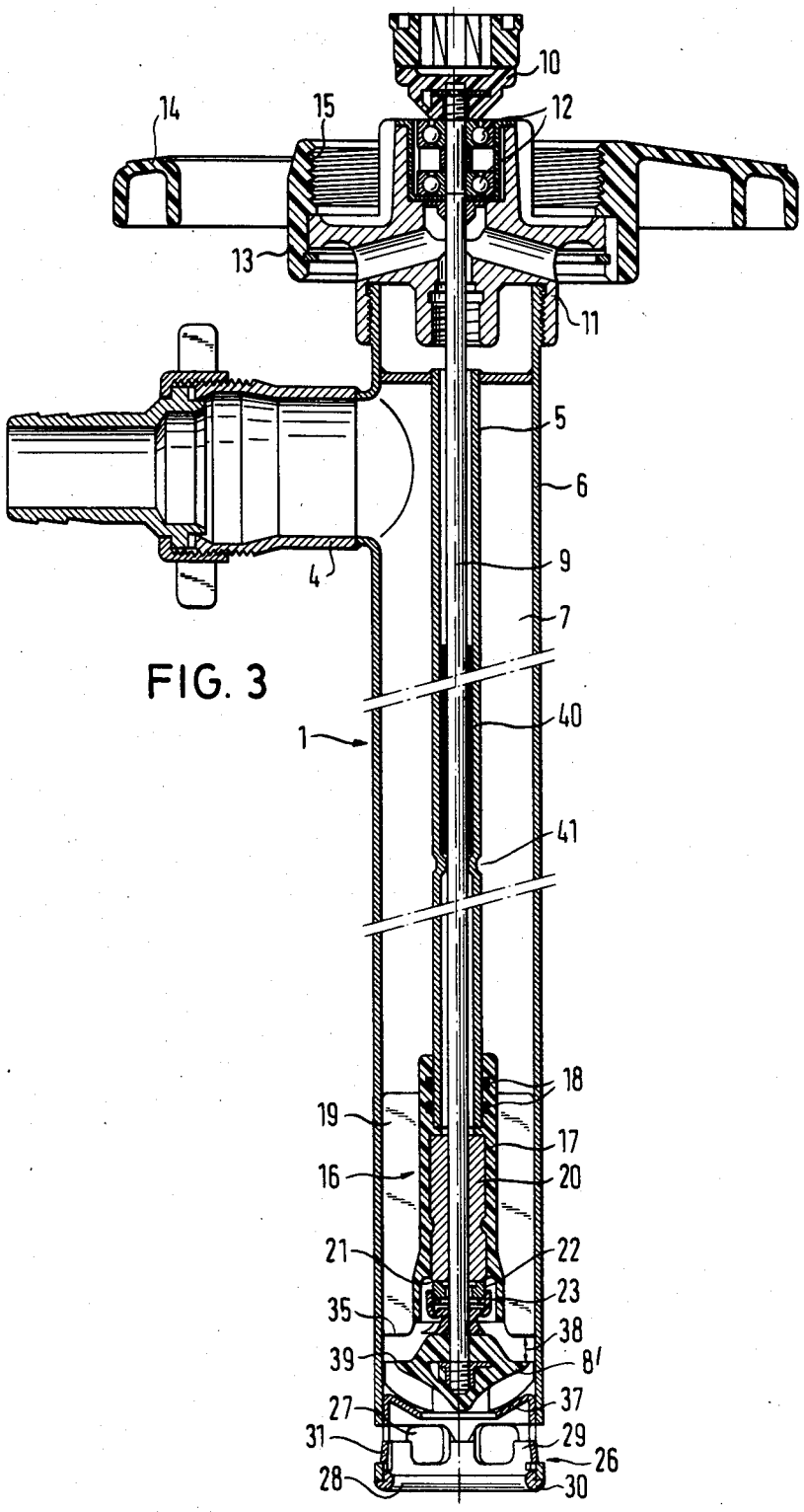

The invention is shown as an example in the illustration. The figures show the following:

FIG. 1 a view of the pump described in its entirety;

FIG. 2 a cross-section through the pump in enlarged detail, without a motor and with an axial impeller; and FIG. 3 a portrayal of a pump as in FIG. 2, but with a radial impeller.

FIG. 1 shows a barrel pump with a tubular pump body (1) and a driving motor (constituted as an electromotor) (2), whose electrical wire is shown as (3). The pump outflow (4) is shown, in this example, as a hose with an attached pistol tap. Because the pump is built to transport liquid out of barrels, the tubular pump body (1) has a diameter that allows the pump to be inserted in the bungholes usually provided.

FIGS. 2 and 3 are longitudinal cross-sections of the pump body (1), in which the middle part of the pump body has been cut away, since it is not necessary for the explanation of the invention.

Since the pumps in FIGS. 2 and 3 differ only in the pump foot, the same references have been used for the other parts.

The pump body designated in its entirety with (1) consists of a support pipe (5) and a tubular housing (6), which between them encompass an annular transport channel (7), through which the fluid is pumped up to the outflow (4) by means of an impeller (8) which sits on the lower end of a drive shaft (9) which runs inside the support pipe (5) and is provided, at its upper end, with a coupling (10), to which the drive motor (2) shown in FIG. 1 can be attached.

The support pipe (5) and the housing (6) are, at their upper ends, connected by a bearing housing (11), whose revolving bearing (12) provides support for the drive shaft (9). Opposite the bearing housing (11) is a revolving screwcap (13) which has been supplied with a handwheel (14) to connect the pump body (1) with the motor (2), whereby the cap (13) is designed with an internal screw thread (15) which works with a corresponding outer screw thread on the motor (2). The pump body (1) can be separated easily from the motor since the coupling (10) has been designed as the uptake part of a socket, in connection with which, at the drive end of the motor, a receiver is permanently attached, which makes a connection in the coupling part (10) when the motor and the body of the pump are attached.

In the lower section of the housing (6) is a fixed guide wheel (16), whose hub (17) has been slid onto the lower end of the support pipe (5) and firmly attached by means of two sealing washers (18). The guide blades (19) on the guide wheel (16) are supported in their installed position by the snug fit against the inner wall of the housing (6). In the interior of the hub (17) is a carbon bearing (20), which is ground flat on its underside so that a ceramic ring (22) can be pressed against this surface (21) by means of an elastic bellows (23), which rests on the upper end of the hub (24) of the impeller (8). This impeller (8) is designed as an axial impeller and exhibits screw-shaped blades (25), which sit on the hub (24) and have an outer diameter which corresponds to the interior diameter of the housing (6) with slight clearance.

The housing (6) extends with its foot (26) out over the impeller (8) and has apportioned around its circumference intake apertures (27). These serve as entry holes for the fluid, since the fluid cannot enter through the open lower end, because the pump foot rests on the floor of the barrel or container. So that the relatively sharp end of the housing (6) does not damage the floor of the container, which might under certain conditions consist of easily damaged man-made materials, a support ring (28) is provided, which offers a bulging thickened area on the lower end of the housing. This support ring encompasses an apron (29), which can be inserted into the housing, and a bulging support rim (30), which sits at the under ring surface of the housing (6), so that the outer diameter of this support rim (30) corresponds with the outer diameter of the housing (6). The apron (29) is equipped with a spring attachment bracket (31) oriented to face outward, which projects slightly beyond the outer circumference of the apron (29) and can engage in the intake apertures (27). Thus, this attachment bracket can press out only so far as it can fit into the intake apertures (27) without, however, extending beyond the outer surface of the housing (6).

The impeller (8) designed as an axial impeller is, in FIG. 2, shown as being made of man-made material and has on the inside an integral nut (32), whereby the impeller can be screwed to the lower end (33) of the drive shaft (9), which has been equipped with an outside screw thread. The nut (32) is positioned in the hub (24) so that there is a space between the impeller blade's exit edge (34) and the guide blade's entrance edge (35), a distance which, in the illustration, amounts to approximately 10% of the outer diameter of the impeller. This distance is designated with (36).

The manner of construction illustrated in FIG. 3 differs from the one illustrated in FIG. 2 only in the lower pump section, where the axial impeller (8) is replaced by a radial impeller (8'). With a radial impeller, the inflow of the fluid to be transported must happen in the center so that there can arise a current at the wheel itself from the inside to the outside. We have therefore installed an intake orifice (37) in the housing (6) before the radial impeller (8'). This intake orifice is solidly attached to the support ring (30) and is therefore easily inserted and removed with the support ring (30), since, as described in connection with FIG. 2, the support ring (30) is engaged in the intake apertures (27) by means of the attachment bracket (31). All that is necessary for disassembly is the turning of the support ring (30) somewhat, until the brackets (31) are pressed inward by the inner wall of the housing (6) and thereby are disengaged from the intake apertures (27). Thereafter, the support ring (30) can be removed, at which point, in the case of the configuration of FIG. 3, the wear ring (37) is also removed (because these two parts are connected with one another as shown in the configuration of FIG. 3). The distance (38) between the guide wheel's entrance edge (35) and the impeller blade's exit edge (39) is larger than in the case of the axial impeller, and, in the example shown here, amounts to approximately 20% of the diameter of the impeller. This larger distance as compared with the axial impeller configuration is necessary in order to introduce a certain calmness to the current before it flows into the guide wheel. In this configuration, what happens is that the current in the region of the impeller blade's exit edge is restricted to a considerably narrower annular section than is the case with the axial impeller configuration, where the outer diameters of this annular section coincide in both cases and are defined by the interior wall of the housing.

With long drive shafts, the danger exists that they will start to sway. To prevent this, a tube of synthetic materials (40) is slid over the drive shaft (9), and sits loosely between the drive shaft (9) and the support pipe (5). The plastic tube (40) possesses self-lubricating properties. This avoids a central bearing, which would be difficult to install in the relatively long support pipe. The plastic tube is prevented from falling down to the bearing (20) by a crimp (41).

I claim:

1. Pump, specifically a barrel pump, with a tubular housing, whose upper part has an outflow and whose lower part, the pump foot, has an intake for the fluid to be transported, a supporting pipe which, with the outer housing, forms an annular transport channel and which serves as the housing for a drive shaft, on the lower end of which is a free-sitting impeller, which is situated inside the housing in the direction of the flow before a permanently fastened guide wheel, whose wings reach to the outer housing, which wings, on the entrance side, exhibit a curved region and an adjacent straight region running parallel to the axis, a region whose length corresponds to a three-fold to six-fold length of the curved region and through which the transportation channel within the curved region of the guide wheel is narrowed down to correspond with the region parallel to the axis, characterized by the fact that the pump (1) is equipped with an axial impeller (8) and interchangeably with a radial impeller (8'), both of which are interchangeable on the end of the drive shaft (33), whereby the outer diameters of both impeller types (8, 8') are identical and correspond (allowing for a little play) with the inner diameter of the housing (6), and so that, in the case of the use of a radial impeller (8'), an intake orifice (37) is replaceable in the housing (6) before the impeller (8').

2. Pump, as described in claim 1, characterized by the fact that the relation of the hub diameter of the axial impeller to the outer diameter of the impeller amounts to 0.4 to 0.6.

3. Pump, as described in claim 1, characterized by the fact that the hub (17) of the guide wheel (16) in the area of the curved wings exhibits an orientation parallel to the axis, with a larger diameter than in the straight area of the wings, an area which is also constructed parallel to the axis and is connected with the area with the larger diameter by a small conical connecting piece.

4. Pump, as described in claim 1, characterized by the fact that the relation of distance (38; 36) from the impeller's exit edge (39; 34) to the guide wheel's entrance edge (35) and to the impeller's outer diameter amounts to 0.15 to 0.25 for the radial impeller (8'), and to 0.05 for 0.15 at the axial impeller.

5. Pump, as described in claim 1, characterized by the fact that, at the guide wheel (16), the relation of the hub diameter in the narrowed area to the hub diameter in the widened area amounts to 1 to 1.25.

6. Pump, as described in claim 1, characterized by the fact that the relationship of the hub diameter of the guide wheel (16) at the entrance to the outer diameter of the guide wheel amounts to 0.45 to 0.50.

7. Pump, as described in claim 1, characterized by the fact that the relationship of the hub diameter of the guide wheel at the exit to the outer diameter of the guide wheel amounts to 0.35 to 0.45.

8. Pump, as described in claim 1, characterized by the fact that the relationship of the length of the guide wheel (16) to the outer diameter of the guide wheel amounts to 1.25 to 1.75.

9. Pump, as described in claim 1, characterized by the fact that the relationship of the length of the guide wheel's (16) section of curved wings to the outer diameter of the guide wheel amounts to 0.3 to 0.4.

10. Pump, as described in claim 1, characterized by the fact that the entrance angle at the guide wheel (16) amounts to 35° to 55°.

11. Pump, as described in claim 1, characterized by the fact that the guide wheel (16) with its hub (17) is loosely fastened to the support tube (5) and supports itself with its wings (19) on the inner wall of the housing with a snug fit.

12. Pump, as described in claim 11, characterized by the fact that, on the interior of the hub (17), there is at least a clamping and sealing ring (18), which serves to attach the hub (17) to the support pipe (5).

13. Pump, as described in claim 1, characterized by the fact that the housing (6) is constituted as a one-piece tube with a constant diameter, which is furnished with intake apertures (27) distributed around the circumference at the lower end, the pump foot (26).

14. Pump, as described in claim 1, characterized by the fact that, at the pump foot (26), a supporting ring (28) is loosely attached, which covers up the housing end from beneath, so that its outer diameter corresponds with the outer diameter of the housing.

15. Pump, as described in claim 14, characterized by the fact that the support ring (28) exhibits an apron (29), which fits tightly in the housing with an attachment bracket (31), spring-loaded, oriented in the direction of the circumference, a bracket which, on the open end, projects somewhat beyond the outer diameter of the apron, and which can fit into the intake apertures (27).

16. Pump, as described in claim 14, characterized by the fact that the support ring (28) is firmly attached to the intake orifice (27).

17. Pump, as described in claim 1, characterized by the fact that the relation of the inner diameter of the intake orifice (37) to the outer diameter of the impeller amounts to 0.4 to 0.6.

* * * * *

UNITED STATES PATENT AND TRADEMARK OFFICE

CERTIFICATE OF CORRECTION

PATENT NO. : 4,668,166

DATED : May 26, 1987

INVENTOR(S) : Karl Lutz

It is certified that error appears in the above-identified patent and that said Letters Patent is hereby corrected as shown below:

On the title page, in the Abstract line 6, "as" should read -- an --.

Column 2, line 13, "configuraion" should read -- configuration --.

Column 5, line 52, "for", second occurrence, should read -- to --.

Signed and Sealed this

Twenty-second Day of December, 1987

*Attest:*

DONALD J. QUIGG

*Attesting Officer*

*Commissioner of Patents and Trademarks*